United States Patent [19]

Kelber

[11] Patent Number: 4,713,858

[45] Date of Patent: Dec. 22, 1987

[54] LEAF COLLECTION APPARATUS FOR BLOWER-VACUUMS

[76] Inventor: John D. Kelber, 1093 Suffield, Birmingham, Mich. 48009

[21] Appl. No.: 852,720

[22] Filed: Apr. 14, 1986

[51] Int. Cl.[4] ..... A47L 5/32

[52] U.S. Cl. ..... 15/347; 15/339; 15/344; 56/DIG. 8

[58] Field of Search ..... 15/339, 347, 344, 330; 56/DIG. 8, 202

[56] References Cited

U.S. PATENT DOCUMENTS

| | | | |
|---|---|---|---|
| 1,418,476 | 6/1922 | Schaefer | 56/DIG. 8 |
| 3,460,185 | 8/1969 | Cook | 15/340 |
| 3,522,695 | 8/1970 | Musgrave | 56/202 X |
| 3,611,685 | 10/1971 | Allina | 56/202 |
| 3,624,989 | 12/1971 | Gatheridge | 15/347 X |
| 3,984,893 | 10/1976 | Ashley | 15/340 X |
| 4,227,280 | 10/1980 | Comer | 15/330 |
| 4,290,165 | 9/1981 | Hiramatsu et al. | 15/330 |
| 4,325,163 | 4/1982 | Mattson et al. | 15/330 |
| 4,451,951 | 6/1984 | Satoh | 15/330 |
| 4,567,623 | 2/1956 | Walton | 15/340 X |

*Primary Examiner*—Chris K. Moore

*Attorney, Agent, or Firm*—Harness, Dickey & Pierce

[57] ABSTRACT

A leaf collection apparatus for use with a blower/-vacuum device. An elongated tube is detachably secured at one end with a unique sleeve mechanism to the blower/vacuum and secured at the other end to a shroud or skirt. The shroud or skirt is adapted to fit over and seal the top of a large container. The sleeve mechanism and shroud are attached to the flexible tube with quick-release fastening mechanisms, and the shroud is adapted to be attached to the large container with a similar mechanism.

4 Claims, 3 Drawing Figures

LEAF COLLECTION APPARATUS FOR BLOWER-VACUUMS

BACKGROUND-SUMMARY OF THE INVENTION

The present invention provides an improved collection apparatus and system for picking up and bagging leaves and other similar items.

In many parts of the country, the Fall season brings great color and beauty to its inhabitants in the form of the changing leaf and foliage coloration. The Fall season, however, also has one distinct drawback. After the leaves go through their spectacular color cycle, they wither and die and fall to the ground. Where the trees are numerous and plentiful, as in the Eastern and Midwestern parts of the United States, the quantity of leaves which fall to the ground causes a considerable disposal problem.

Where the leaves can be raked or blown into piles and burned, the diposal problem is not that difficult. In many suburban or fire-preventative areas, however, regulations and laws prohibit the burning of leaves or other trash. These rules have developed for a variety of reasons; for example, some are designed to prevent the addition of pollutants into the air, while others are designed to prevent the start of forest or brush fires.

In the areas where leaves cannot be burned, other measures must be taken to dispose of the leaves. Often this involves a manual filling or stuffing of containers or plastic bags with the leaves in order to have them picked up and taken away by a trash pick-up or collector company, or have them dumped in a vacant field. It is very difficult and time consuming to pick up and stuff leaves into containers, such as plastic bags, however, and the repetitive process week after week in the Fall becomes a significant chore.

The purpose of the present invention is to provide an improved apparatus and system for pickup and bagging of leaves. The invention utilizes known blower/vacuums and is adapted to deposit the leaves into bags and/or containers in a relatively quick and easy manner—at least more quickly and easily than known systems.

Various blower/vacuum devices are available on the market today for aiding in the collection and pickup of leaves. These products are small and sufficiently light in weight to be hand held and often are convertible to act as either leaf blowing or leaf vacuuming systems. The devices have an electrically operated or gasoline operated motor which turns an impeller or fan at high speeds producing a significant, concentrated wind force. When that wind force is directed at a group of leaves, for example through a nozzle or outlet, the power of the wind force blows the leaves in a desired direction. On the other hand, if the air inlet to the blower/vacuum device is opened up, leaves can be sucked into it and blown out through the air discharge nozzle. The passage of the leaves through the fan or impeller also usually breaks up or mulches the leaves allowing them to be compacted more easily into containers or bags.

Blower/vacuum devices of the type mentioned above are made, for example, by Allegretti & Company and Black & Decker Co. The Allegretti device is called "Vac-N-Sac" and one Black & Decker device is called "Gas Blower/Vac". A device of this type is also shown, for example, in U.S. Pat. No. 4,325,163 which is assigned to Allegretti & Company. Typically, these devices offer as accessory attachments, nozzles which can be used for blowing and/or vacuuming up leaves and a small leaf collection bag. The bag is adapted to be attached to the discharge end of the blower/vacuum and collect mulched leaves which have been passed through the fan or impeller.

The leaf collection and bagging systems known today, and exemplified by the systems mentioned above, have several significant disadvantages. Most notably, the leaf collecting bag is too small and has to be emptied frequently. For large lawns and quantity of leaves, the bag is simply inadequate. Further, the contents of the bag has to be transferred by hand to larger containers or plastic bags which is also time consuming and difficult to accomplish cleanly and easily. Known blower/vacuum leaf collection bags also usually are adapted to hang from the user's shoulder and are bulky and awkward to handle.

The present invention has been designed to overcome the defects and disadvantages associated with and inherent in known leaf collecting systems. The present invention provides an improved leaf pick up and bagging system which allows the user to pick up and bag the collected leaves more easily and faster.

The invention generally comprises an accessory or attachment system which can be used with any of the known blower/vacuum devices. A long flexible and extendable tube is detachably secured at one end with a unique sleeve mechanism to the blower/vacuum and secured at the other end to a shroud or skirt. The shroud or skirt is adapted to fit over and be attached to the top of a large container, such as a trash can. Both the sleeve mechanism and shroud are attached to the flexible tube with quick-release fastening mechanisms, and shroud is adapted to be attached to the large container with a similar mechanism. With this system, leaves can be sucked up by the blower/vacuum and transferred to containers at one convenient centrally-located position. If desired, large plastic bags can be positioned inside the collection containers and the mulched leaves transferred directly into it. This can be done easily, quickly and without the typical problems of sagging sides and misdirected leaves when plastic bags are used.

The present invention has relatively few parts and the parts are relatively inexpensive. Further, the parts are also easily collapsed or folded for storage and transport. This means that the invention can be mass produced relatively inexpensively, sold at a reasonable price for use by most consumers, and adapted to be used and transported easily and quickly by the consumers.

Further objects, features, benefits and advantages of the invention will become apparent from the following description of the preferred embodiments, especially when viewed in accordance with the accompanying drawings:

DESCRIPTION OF THE PREFERRED EMBODIMENTS

Figures 1, 2, 3:
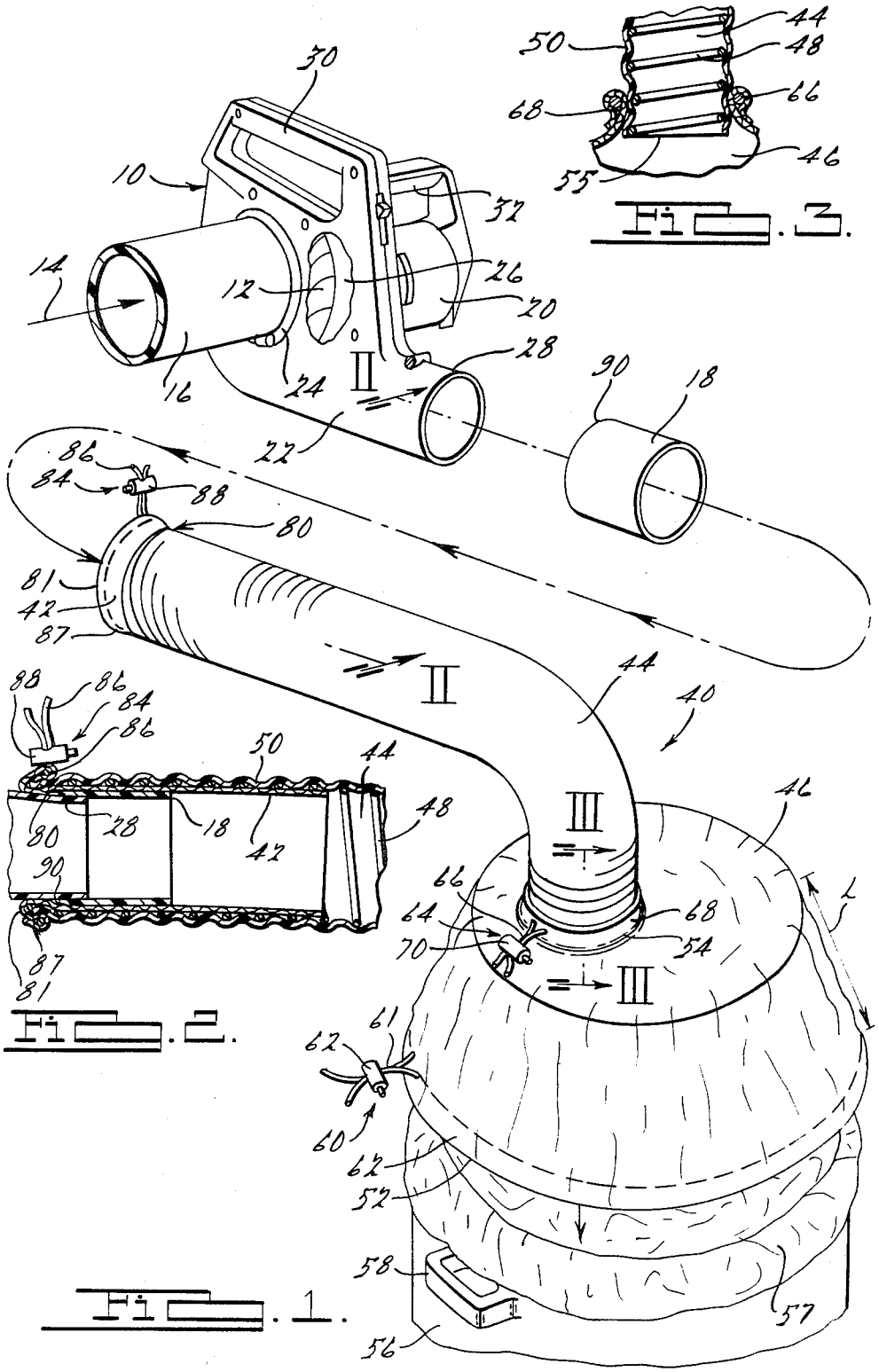
FIG. 1 is an exploded perspective view of the invention depicting how it can be used with a blower/vacuum to pick up leaves and deposit them in a container.
FIG. 2 is a cross-sectional view of one aspect of the invention and taken along lines 2—2 in FIG. 1.
FIG. 3 is a cross-sectional view of another aspect of the invention and taken along lines 3—3 in FIG. 1.

As shown in the drawings, the invention is adapted to be attached to and used with a portable hand-held air blower/vacuum apparatus 10. Examples of known blower/vacuum devices are marketed as "Vac-N-Sac" by Allegretti & Company and "Gas Blower/Vac" by Black & Decker Co., and another is shown and described in U.S. Pat. No. 4,325,163.

The blower/vacuum apparatus comprises a motor-driven impeller 12 for drawing air 14 at a relatively high rate of speed through a flow. A suction tube or nozzle 16 is connected to the air 24 of the flow path whereby leaves, dirt, paper scraps and the like are drawn by the impeller 12 into the flow path and exhausted through an air outlet 28.

A motor (not shown) is included in casing 20 and drives the impeller 12. The motor can be either gas or electric driven and is mounted in or on a portable and relatively lightweight housing 22 formed from an impact-resistant plastic or the like. The motor rotatably drives the relatively lightweight and inexpensive impeller 12 for drawing air axially inwardly through air inlet 24 at a relatively high flow rate and for discharging the air centrifugally into a circumferentially-formed chamber 26 and then through a tangentially directed air outlet 28. Preferably the impeller 12 is adapted to mulch or chop leaves, grass and other material vacuumed through the unit; not only does this provide for more compact material for disposal, but it also prevents clogging or breaking of the impeller.

The housing 22 has a handle 30 and the motor casing 20 has a second handle 32. The two handle members enable the entire unit 10 to be easily handled and oriented in any desired position by the individual operating the unit. An outlet tube or nozzle 18 is adapted to snugly fit over the end of the air outlet 28 of the blower/-vacuum unit 10 and is preferably formed from a plastic material or the like.

Although it is not mandatory for practice of the present invention, the blower/vacuum unit 10 is preferably adapted for use as both a blower and a vacuum. The unit 10 can be converted quickly and easily between the two modes of operation. When used as a blower, the inlet tube or nozzle 16 is removed from the air inlet 24 and a protective grill (not shown) is positioned over the inlet 24. A longer tubular member or nozzle (not shown), often with a tapered directional end, is positioned in the end of outlet tube 18 and used to direct the air stream in the desired direction. Portable blower units are commonly used today in blowing dirt, dust, leaves and the like from surfaces such as sidewalks, driveways, etc. The portable blowers are also used to assist in gathering up leaves into piles in the Fall for burning or bagging.

For use with the present invention, the blower/-vacuum unit 10 is used in its vacuum mode. The longer tubular member is removed from the outlet tube 18 and the tube or nozzle is positioned in the air inlet 24. For use in vacuuming and bagging leaves, the inventive bagging attachment 40 is utilized.

The bagging attachment comprises a protective and securing sleeve member 42, an elongated hose or tubular member 44, and a covering shroud or skirt 46. The sleeve member 42 preferably comprises a protective material liner positioned on the inside and at one end of the tubular member 44 and includes a fastening mechanism 84 at one end. The elongated hose 44 is a collapsible/extendable tubular member having a wire coil spring 48 covered by a flexible cloth or vinyl-like material 50. Preferably the tube is 4–5 feet long which is sufficient for mobility and yet short enough to prevent clogs and bends in the tube which might block or break it. Also, preferably the flexible protective and fastening sleeve 42 extends at least one foot inside the tubular member 44 in order to adequately protect the member 44.

The shroud 46 is made from a suitable filtering material, such as a porous fabric or the like, and is essentially circular in shape. The lower end 52 of the shroud 46 is much larger than the upper end 54 and is sufficiently large to fit over a trash container 56, garbage can, or the like. The shroud also has a sufficient diameter or length "L" to extend below the handles 58 of the container 56 in order to help securely fasten the shroud over the open end of the container during use. A shroud diameter of three feet provides sufficient material to store and be attached to most typical garbage cans and trash containers.

The lower end 52 of the shroud is secured in place around the container by a drawstring mechanism 60 or the like. The drawstring mechanism 60 has a drawstring 61 and a spring-loaded closure member 62 for holding the drawstrings taut after they are tightened. Spring-loaded, closure members which can be used with the present invention include, for example, "Cord-Loks" by T-PlasTech. The drawstring 61 is positioned in a hem or channel 62 formed in the lower end 52 of the shroud.

The upper end 54 of the shroud 46 similarly has a drawstring attachment mechanism 64 for securing it to one end 55 of the elongated hose 44 (see FIG. 3). The attachment mechanism 64 has a drawstring 66 positioned in hem or channel 68 in the shroud and is held in tightened position by spring-loaded closure member 70. It is also possible for the shroud or skirt to be permanently secured to the end 55 of the hollow tubular member 44.

As can be seen from FIG. 1, the opening in the upper end 54 of the shroud is not concentric with the opening in the lower end 52 of the shroud. Instead, the upper end opening 54 is positioned off-center so that it will be positioned closer to one edge of the container 56. In this manner, the range of mobility or "sweep" of the vacuum is increased significantly for a stationary container 56. It is also possible to provide excess material in the shroud 46 so that the entrance of the hose 44 into the container has significant freedom of movement to compensate for movement of the vacuum unit 10 in vacuuming up leaves.

The end 80 of the elongated hose 44 which is adapted to be attached to the air outlet 28 and over the outlet tube 18 has a flexible sock or sleeve 42 positioned inside of it. The flexible sleeve 42 is used to absorb the force and impact of the leaves and other debris against the hose 44 so that the hose will not become easily punctured or torn. In this regard, the sleeve 42 is positioned at the end 80 of the hose where the leaves, etc., first enter and impinge on it. This is where the speed, force and impact of the leaves are the greatest and where the hose has the greatest chance of being punctured.

The flexible outer sleeve 42 has a fastening mechanism 84 in order to securely attach it to the end 80 of the hose 44. The flexible sleeve 42 may also be permanently attached to the end 80 of the hose 44; this can be done by any conventional means, such as gluing, riviting, sewing or stapling. The tightening mechanism 84 has a drawstring 86 positioned in a channel or hem 87 and a spring-loaded closure member 88 to hold the drawstring in its tightened position.

As shown in FIG. 2, the hose 44 is secured on the vacuum unit 10 by situating the flexible sleeve 42 over the outlet tube 18 and tightening and securing the drawstring mechanism 84. One end 90 of the tube 18 provides a shoulder or "stop" to prevent the sleeve 42 and tube 44 from slipping off the end of the air outlet during use. Also, the end 81 of the flexible sleeve 42 wraps around the free end 80 of the elongated tubular member or hose 44. The sleeve 42 is held in place on the tubular member 44 and the member 44 in turn is held in position on the air outlet 28 of the blower/vacuum 10 by means of the drawing mechanism 84 and closure member 88.

Although the tightening mechanisms 60, 64 and 84 have been described as utilizing drawstrings and spring-loaded closure members, it is understood that any conventional types of fastening mechanisms which can securely hold the various components together can be used. For example, Velcro hook-and-loop fasteners using straps mounted in the channels or hems 62, 68 and 87, or connected to the outside surfaces of the flexible connecting members, could be utilized.

When the present invention is used, it is set up as shown in FIGS. 1–3. The tubular member 44 is attached to the shroud 46 and the shroud is attached to the container 56. The other end 80 of the hose is then attached in a similar manner over the air outlet nozzle 18 and to the blower/vacuum unit 10. (It is also possible to change the order of these steps and still secure the same result.) Finally, the vacuum unit 10 is started and the pile of leaves or the like is sucked up into the air inlet 16.

Once the container 56 has been filled with the mulched leaves and grass, the closure mechanism 60 is loosened and the shroud removed. The container is then dumped and easily and quickly reattached to the shroud for reuse. It is also possible to line the container 56 with a plastic bag 57 or the like so that the leaves, etc., can be disposed of more easily. When a plastic bag is used, it is filled quickly and easily without a lot of effort or mess. Once the bag is stuffed, it can be removed from the container, secured with a "tie-twist", and disposed of with other trash.

The foregoing discussion disclosure and describes merely exemplary embodiments of the present invention. Once skilled in the art will readily recognize from such discussion that various changes, modifications and variations may be made therein without departing from the spirit and scope of the invention as defined in the following claims.

I claim:

1. A leaf collection apparatus for attachment to a hand held portable vacuum device, said vacuum device including a vacuum inlet and an air outlet, said inlet for drawing leaves into said vacuum device and said outlet for ejecting leaves from said vacuum device into and through said leaf collection apparatus to deposit the leaves into a suitable container, said leaf collection apparatus comprising:

an elongated flexible hose having a sleeve end and a discharge end;

sleeve means operable for attachment between said outlet of the vacuum device and said sleeve end of said hose, said sleeve means attaching the sleeve end of the hose to the vacuum device and protecting the hose from being punctured by leaves entering said hose from said outlet;

shroud means having a hose connecting end and a container end;

first and second adjustable connection means integral with said hose connecting end and said container end respectively for allowing releasably adaptable connection of said shroud means between varying sizes of hoses and varying sizes of containers;

third adjustable connection means at said sleeve end of said hose for allowing releasably adaptable connection to accommodate varying sizes of air outlets for allowing releasable adaptable connection to varying sizes of outlets of the vacuum device;

said shroud means sealingly attached to said discharge end of said hose at said hose connecting end and sealingly attached to a suitable container at said container end by said first and second adjustable connection means respectively, said shroud means acting as an intermediary adapting member between said hose and the container for allowing deposit of leaves from said hose into the container, whereby said leaf apparatus is adaptable to deposit leaves in a variety of sizes of containers and is adaptable for connection to a variety of sizes of outlets of hand held portable vacuum devices.

2. The leaf collection apparatus of claim 1 wherein at least one of said first adjustable connection means and said second adjustable connection means comprises a drawstring attachment mechanism.

3. The leaf collection apparatus of claim 1 wherein said hose connection portion is eccentrically positioned on said shroud thereby allowing said vacuum device to be operated at a greater distance from said container for vacuuming of a larger area from said container.

4. The leaf collection apparatus of claim 1 wherein said apparatus is collapsible for storage.

* * * * *

UNITED STATES PATENT AND TRADEMARK OFFICE

CERTIFICATE OF CORRECTION

PATENT NO. : 4,713,858

DATED : December 22, 1987

INVENTOR(S) : John D. Kelber

It is certified that error appears in the above-identified patent and that said Letters Patent is hereby corrected as shown below:

On the title page

References Cited - U.S. Patent Documents Patent No. 4,567,623 "2/56" should be --2/86--.

| | | |
|---|---|---|
| Column 2, | line 35, | before "shroud" insert --the--. |
| Column 3, | line 13, | after "flow" insert --path--. |
| Column 3, | line 14, | after "air" insert --inlet--. |
| Column 3, | line 60, | "nozzle" should be --nozzle 16--. |
| Column 4, | line 68, | "riviting" should be --riveting--. |
| Column 5, | line 16, | "drawing" should be --drawstring--. |
| Column 5, | line 47, | "disclosure" should be --discloses--. |
| Column 5, | line 49, | "Once" should be --One--. |
| Column 6, | line 29, | after ";" insert --and--. |

Signed and Sealed this

Twenty-seventh Day of September, 1988

*Attest:*

*Attesting Officer*

DONALD J. QUIGG

*Commissioner of Patents and Trademarks*